US005793276A

United States Patent [19]

Tosaka et al.

[11] Patent Number: 5,793,276

[45] Date of Patent: Aug. 11, 1998

[54] ORGANIC PTC THERMISTOR

[75] Inventors: Hisanao Tosaka; Minoru Takaya; Shigeru Moriya; Hisashi Kobuke; Munemitsu Hamada, all of Tokyo, Japan

[73] Assignee: TDK Corporation, Tokyo, Japan

[21] Appl. No.: 682,301

[22] Filed: Jul. 17, 1996

[30] Foreign Application Priority Data

| | | | |
|---|---|---|---|
| Jul. 25, 1995 | [JP] | Japan | 7-189096 |
| Sep. 27, 1995 | [JP] | Japan | 7-273550 |
| Jan. 23, 1996 | [JP] | Japan | 8-009084 |
| Jun. 13, 1996 | [JP] | Japan | 8-174231 |

[51] Int. Cl.[6] ..... H01C 7/00

[52] U.S. Cl. ..... 338/22 R; 338/309; 338/324; 338/327; 338/328; 338/332

[58] Field of Search ..... 338/22 R, 225 D, 338/28, 25, 309, 324, 327, 328, 332, 333, 334; 219/552, 548, 541

[56] References Cited

U.S. PATENT DOCUMENTS

| | | | |
|---|---|---|---|
| 3,591,526 | 7/1971 | Kawashima et al. . | |
| 3,673,121 | 6/1972 | Meyer . | |
| 4,237,441 | 12/1980 | Van Konynenburg et al. . | |
| 4,369,343 | 1/1983 | Sone et al. | 200/19 R |
| 4,545,926 | 10/1985 | Fouts, Jr. et al. . | |
| 4,924,204 | 5/1990 | Uchida | 338/22 R |
| 4,977,309 | 12/1990 | Uchida | 217/541 |
| 5,212,466 | 5/1993 | Yamada et al. | 338/22 R |
| 5,214,738 | 5/1993 | Nakajima et al. | 338/22 R |
| 5,245,309 | 9/1993 | Kawase et al. | 338/22 R |
| 5,247,276 | 9/1993 | Yamazaki | 338/22 R |

FOREIGN PATENT DOCUMENTS

| | | |
|---|---|---|
| 0 045 630 | 2/1982 | European Pat. Off. . |
| 33 11 051 | 9/1984 | Germany . |
| 62-85401 | 4/1987 | Japan . |
| 2-86087 | 3/1990 | Japan . |
| 2-16002 | 4/1990 | Japan . |
| 4-44401 | 7/1992 | Japan . |
| WO 91/19297 | 12/1991 | WIPO . |

OTHER PUBLICATIONS

T.R. Shrout, et al. "Optimun $TiB_2$ Ceramic Powder for Composite Thermistors", Journal of Materials Science Letters, No. 9, (pp. 611–612), 1990.

T.R. Shrout, et al. "Composite PTCR Thermistors Utilizing Conducting Borides, Silicides, and Carbide Powders", Journal of Materials Science, No. 26, (pp. 145–154), 1991.

Iwao Sugaya, et al. "Low power Consumption Technology of 'Viewcam'", Sharp Giho, (pp. 49–52), May, 1994.

Derwent Publications, Database WPI, an 90–365449, JP 02 263 877, Oct. 26, 1990.

Patent Abstracts of Japan, vol. 017, No. 460, (E–1419), Aug. 23, 1993, JP 05 109502, Apr. 30, 1993.

Patent Abstracts of Japan vol. 012, No. 194, (p–713), Jun. 7, 1988, JP 62 299833, Dec. 26, 1987.

*Primary Examiner*—Adolf Berhane

*Attorney, Agent, or Firm*—Oblon, Spivak, McClelland, Maier & Neustadt, P.C.

[57] ABSTRACT

An organic PTC thermistor having a positive temperature coefficient of resistivity, which comprises a PTC composition comprising an organic polymer having dispersed therein a conductive substance, and at least one pair of electrodes, wherein the conductive substance is tungsten carbide powder; or the electrodes each comprise a metal mesh and a metal layer.

28 Claims, 15 Drawing Sheets

ORGANIC PTC THERMISTOR

FIELD OF THE INVENTION

This invention relates to an organic polymer thermistor exhibiting a positive temperature coefficient of resistivity (PTC) (hereinafter referred to as an organic PTC thermistor). More particularly, it relates to an organic PTC thermistor useful as a preventive element against overcurrent in the door lock motor of automobiles or batteries or as a preventive element against overheat of a back-lighting fluorescent tube.

BACKGROUND OF THE INVENTION

Conductive compositions comprising an organic polymer, such as polyethylene or polypropylene, having dispersed therein conductive powder, such as carbon black or metallic powder, exhibits PTC characteristics. These conductive compositions are known to have a lower volume resistivity at room temperature as compared with conventional ceramic PTC compositions, to be capable of being used in high current circuits, to be expected to have a reduced size, and to show a high rate of resistivity change with temperature (i.e., maximum resistivity/room temperature resistivity). Known organic conductive compositions are disclosed, e.g., in U.S. Pat. Nos. 3,591,526 and 3,673,121.

Thermistors comprising an organic polymer containing, as a conductive powder, a non-oxide ceramic powder, such as TiC, $TiB_2$, TiN, ZrC, $ZrB_2$, ZrN, and NbC, are disclosed, e.g., in JP-A-2-86087 (the term "JP-A" as used herein means an "unexamined published Japanese patent application"), *Journal of Materials Science Letters*, No. 9, pp. 611–612 (1990), and ibid, No. 26, pp. 145–154 (1991).

Known techniques for forming electrodes on these PTC compositions include direct plating of metal (JP-B-4-44401, the term "JP-B" as used herein means an "examined published Japanese patent application"), embedding of a metal-made mesh electrode in the PTC composition (JP-B-2-16002), and sputtering (JP-A-62-85401).

It is generally desired for PTC thermistors used as an overcurrent preventive element for the door lock motor of an automobile or batteries to have a room temperature volume resistivity of not higher than 1 Ω-cm and a rate of resistivity change as expressed by the following equation of not less than 5.

$$\text{Rate of resistivity change} = \log_{10}(\text{maximum resistivity}/\text{initial resistivity})$$

To have a reduced resistance will allow not only size reduction of the element but permit application to a high current circuit under normal operating conditions. An increase of the conductive substance content results in reduction in resistance but, in turn, the rate of resistivity change will be reduced, tending to fail to cut off the electric current in case of abnormality.

A practically useful organic thermistor containing carbon black as a conductive substance has a high room temperature resistivity of about 2 Ω-cm, which is hardly expected to be further lowered, and has been deemed unsuited for use in high current circuits. Thermistors using metallic powder as a conductive substance achieve a reduced room temperature volume resistivity but exhibit poor durability against actual load in an on-off test, etc., proving impractical.

The above-mentioned thermistors comprising an organic polymer having dispersed therein non-oxide ceramic powder are excellent in heat resistance, mechanical strength and chemical stability and are expected to have satisfactory repeatability and stability when used for prevention of overcurrent due to a shortcircuit of a secondary battery in charging or discharging or lock of a motor. However, the non-oxide ceramic powder incorporated into an organic polymer cannot have a reduced resistivity unless it is added in a considerably increased amount as compared with carbon black. Use of such an increased amount of the non-oxide ceramic powder results in difficulties in kneading and molding. Besides, it has been difficult to obtain a small-sized thermistor suitable for high current circuits.

With respect to formation of electrodes, the method comprising embedding a metal-made mesh electrode in the surface of a PTC composition (shown in FIG. 17) fails to reduce the resistivity for the size of the PTC composition and is also disadvantageous in that the resistivity is instable. The method consisting of direct plating with metal or sputtering tends to involve development of wrinkles or cracks in the electrode film or separation of the electrode film from the PTC composition due to thermal expansion and shrinkage of the PTC composition as shown in FIG. 18.

SUMMARY OF THE INVENTION

An object of the invention is to provide an organic PTC thermistor which can be produced without any difficulty in kneading of conductive powder or in molding and which is excellent in room temperature resistivity, rate of resistivity change, and repeatability.

Another object of the invention is to provide an organic PTC thermistor which is free from instability of resistivity or unfavorable increase of resistivity which might be caused by an electrode.

These and other objects and effects of the invention will be obvious from the description hereinafter given.

The present invention provides in its first embodiment an organic PTC thermistor having a positive temperature coefficient of resistivity, which comprises a PTC composition comprising an organic polymer having dispersed therein a conductive substance, and at least one pair of electrodes, wherein the conductive substance is tungsten carbide powder.

The present invention provides in its second embodiment an organic PTC thermistor having a positive temperature coefficient of resistivity, which comprises a PTC composition comprising an organic polymer having dispersed therein a conductive substance, and at least one pair of electrodes, wherein the electrodes each comprises a metal mesh and a metal layer.

It is preferable that the electrodes in the first embodiment have the same structure as in the second embodiment.

DETAILED DESCRIPTION OF THE INVENTION

Figure 1A:
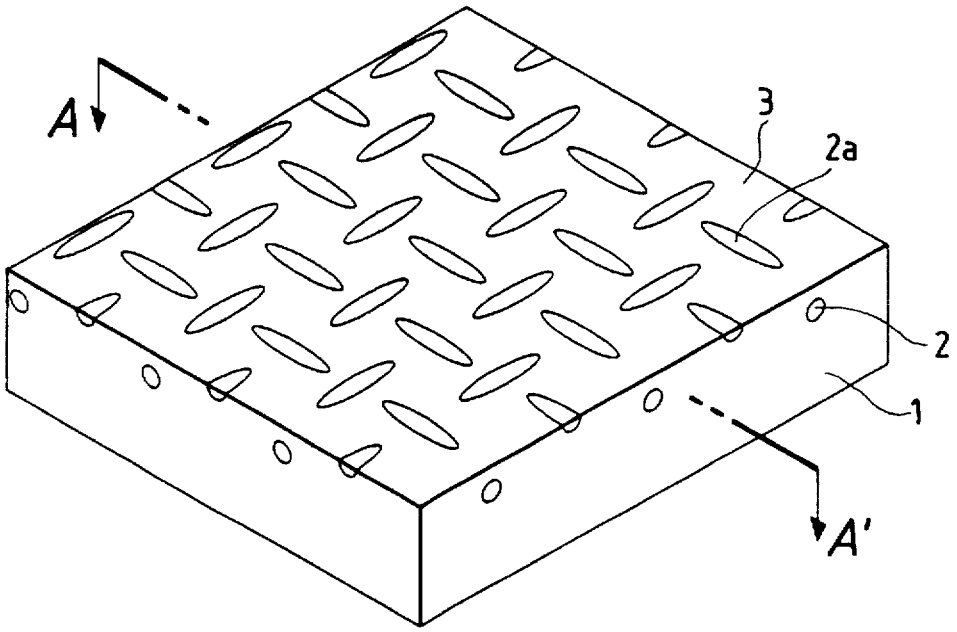
FIGS. 1(*a*) and 1(*b*) show an organic PTC thermistor according to the second embodiment of the invention, in which the thermistor has a sheet form with a metal mesh embedded in the surface thereof.

The first embodiment of the invention will be explained below.

The inventors have extensively studied organic PTC thermistors comprising an organic polymer having incorporated therein non-oxide ceramic powder as a conductive substance. They have found as a result that use of tungsten carbide (hereinafter abbreviated as WC) powder as a conductive substance makes it possible to reduce a room temperature resistivity at a smaller content than has been required of other non-oxide ceramics and yet to achieve a high rate of resistivity change while obtaining excellent repeatability.

For example, all the thermistors of prescribed size prepared from polyvinylidene fluoride (hereinafter abbreviated as PVDF) and a proper amount, e.g., 30% by volume of ZrN, whose volume resistivity at room temperature is nearly the same as that of WC, had a room temperature surface resistivity of 200 MΩ or higher, proving impractical. On the other hand, the room temperature surface resistivity of the thermistor of the same size containing 30% by volume of WC was as incomparably low as 0.007 Ω.

It has not yet been made clear why such a great difference in room temperature resistivity is produced in spite of the equality of the two conductive substances in volume resistivity, with the compounding ratio being equal. The difference seems attributable to the compatibility between the conductive substance and the organic polymer matrix. As previously mentioned, a desired room temperature volume resistivity of a PTC thermistor for the uses intended in the present invention is 10 Ω-cm or lower. According to the first embodiment of the invention, such a low level of room temperature volume resistivity can easily be attained by using WC at a smaller content.

That is, the invention is characterized in that WC powder is used as a conductive substance in an organic PTC thermistor to reduce a volume resistivity at room temperature (25° C.) to 10 Ω-cm or lower.

The WC powder to be used preferably has an average particle size of not greater than 10 μm in order to secure a prescribed low breakdown voltage, and still preferably not greater than 1 μm for further reducing the room temperature resistivity. WC powder smaller than 0.1 μm is expensive and difficult to knead. Accordingly, a preferred average particle size is 0.1 to 10 μm, still preferably 0.1 to 1 μm, particularly preferably 0.5 to 1 μm.

The organic polymer used in the invention is not particularly limited as long as it is a thermoplastic and crystalline polymer. For example, polyvinylidene fluoride (PVDF) polyethylene, polypropylene, polyvinyl chloride, polyvinyl acetate, an ionomer, or a copolymer comprising monomers of these polymers can be used. In particular, because PVDF exhibits self-extinguishing properties (properties of spontaneously extinguishing the fire it has caught upon removal of a flame), it is suited for use in places having fear of fire.

The amount of WC powder to be added preferably ranges from 20 to 50% by volume, more preferably from 23 to 50% by volume, still preferably from 25 to 40% by volume, based on the PTC composition. If the WC content is less than 20%, a rise of room temperature resistivity is observed. If it exceeds 50%, the ratio of the powder to the polymer is so high that the torque required for kneading increases, tending to make kneading and molding difficult.

While the thermistor of the first embodiment is not restricted by process of production, the following process may be mentioned as a typical example. A PTC composition comprising a crystalline polymer having dispersed therein WC is kneaded in a kneading machine, such as a Banbury mixer or a mixing roll. An antioxidant or a kneading assistant, such as a surface active agent, may be added in this stage. The resulting blend is molded with a hot press into a sheet or a film. While not essential, the polymer may be subjected to crosslinking for inhibiting the fluidity after PTC manifestation thereby to stabilize the resistivity. The crosslinking can be carried out by electron-induced crosslinking in the presence a crosslinking assistant (added to enhance the efficiency of electron rays or crosslinking efficiency) (see U.S. Pat. No. 3,269,862), chemical crosslinking, or water-induced crosslinking comprising grafting a silane compound to a crystalline polymer in the presence of a free radical generator and then bringing the graft polymer into contact with water or an aqueous medium in the presence of a silanol condensation catalyst (see JP-B-4-11575).

An electrode is formed on both main sides facing each other by press bonding a metal plate under heat (see U.S. Pat. No. 4,426,633), plating with metal (see JP-B-4-44401), coating with a conductive paste (see JP-A-59-213102), sputtering (see JP-A-62-85401), flame spray coating (see JP-A-62-92409), and the like. It is particularly preferable that each electrode has the structure according to the second embodiment of the invention hereinafter described, i.e., a combination of a metal mesh and a metal layer.

If desired, the resulting PTC sheet is punched or cut out to a prescribed shape and size, and a metallic lead wire is soldered to each electrode. If desired, the PTC thermistor may be encapsulated in an insulating resin, or a conductive adhesive may be applied to the electrode, via which a terminal made of another metal can be connected.

Unlike the above-described structures, the thermistor may have a multilayer structure in which a plurality of PTC sheets and a plurality of electrode layers alternate so as to have two or more pairs of electrodes facing each other with a PTC sheet therebetween. Such a structure can be formed by a sheeting method or a printing method, or a combination of these methods and a thin film formation technique, such as sputtering.

The thermistor according to the second embodiment of the invention is then described below.

The organic PTC thermistor of the second embodiment is characterized in that a pair of electrodes have a structure composed of a combination of a metal mesh and a metal layer. By virtue of this electrode structure, the PTC thermistor can have a resistivity correspondent with the size of the PTC composition and exhibits stabilized resistivity.

The metal mesh is preferably provided by embedding in the surface of a PTC composition with a part of it exposed. In this case, the initial resistivity of the PTC composition decreases, and the stress by thermal stress can be relaxed, which provides mechanical reinforcement for preventing the PTC composition and electrodes from being deformed or developing cracks, etc.

The metal mesh preferably has an opening size of 200 to 600 mesh. The metal mesh having the preferred opening size can be prepared at low cost and is easy to punch or cut into a prescribed shape.

The metal mesh is preferably at least one of plain weave mesh, twilled weave mesh, plain weave mesh having been squashed (flattened), twilled weave mesh having been squashed (flattened), and mesh with no difference in level at the intersections. In this case, the metal mesh can have a reduced thickness while providing an increased exposed area of the metal on the surface of the PTC composition, the final product can thus have a reduced thickness, and the abrading operation (hereinafter described) is easier.

The metal layer is preferably at least one of a metal layer formed by chemical plating, a metal layer formed by electroplating, a metal layer formed by vacuum vapor phase deposition, and a metal layer formed by flame spray coating. In this case, the PTC composition can have a reduced initial resistivity.

The metal layer is preferably formed after the above-described metal mesh has been embedded with a part of it exposed and the surface of the PTC composition containing the exposed metal mesh has been abraded to increase the exposed area of the mesh and the conductive substance. In this case, the resistivity can be stabilized and is further reduced.

The organic polymer in the organic PTC thermistor of the second embodiment is not particularly limited, and can be preferably selected from polyethylene, polypropylene, polyvinylidene fluoride, polyvinyl chloride, polyvinyl acetate, an ionomer, or a copolymer comprising monomers of these polymers. The conductive substance is preferably selected from carbon black (e.g., furnace black or acetylene black), graphite, carbon fiber, conductive whiskers, metallic particles (e.g., Ni, Cu, Ag, Fe or Cr), and conductive ceramic powders. By using the above-mentioned organic polymer and conductive substance, the resistivity, rate of resistivity change, breakdown voltage, stability of resistivity-temperature (R-T) characteristics against repetition, and reliability are improved.

Of the conductive ceramic powders, tungsten carbide (WC) is particularly preferred. Use of WC provides a PTC thermistor having a reduced resistivity and excellent stability of R-T characteristics against repetition and makes it feasible to reduce the size of the PTC thermistor.

Figure 1B:
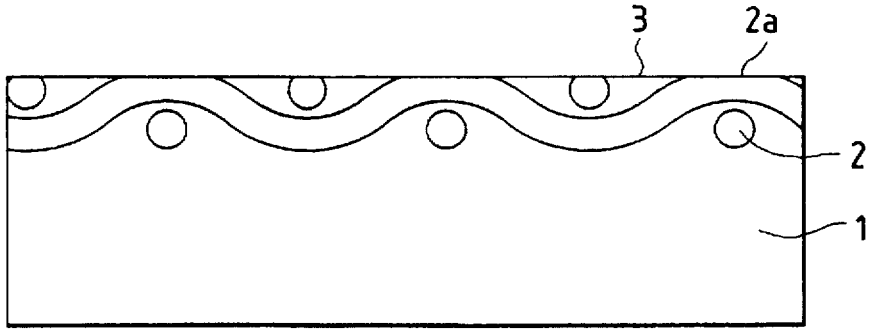

FIG. 1(*a*) is a perspective view of the organic PTC thermistor according to the second embodiment, in which a metal mesh is embedded in the surface of a PTC composition having a sheet form. FIG. 1(*b*) is a cross section of FIG. 1(*a*) along line A-A'.

In FIGS. 1(*a*) and 1(*b*), numeral 1 denotes a body of a PTC composition, 2 denotes a metal mesh, 2*a* denotes an intersection of the metal mesh, and 3 denotes a metal layer.

The thermistor of the second embodiment is not restricted by process of production. For example, it is produced by kneading an organic polymer and a conductive substance, molding the blend and, if desired, subjecting the molded article to crosslinking in the same manner as in the first embodiment. Thereafter, a metal mesh is embedded in each of the main surfaces of the molded article by, for example, press bonding under heat.

While the mesh desirably has fine mesh, a metal mesh having extreme fineness is of little real use because of its high cost of production. A coarse metal mesh will have a larger wire thickness than in usual metal meshes so that the stock sheet after formation of electrodes has poor workability in punching or cutting to a prescribed shape. Besides, burrs tend to be formed at edges on punching or cutting. From these considerations, the mesh preferably has an opening size of 200 to 600 mesh. The term "mesh" as used as a unit of mesh fineness means the number of openings in a 1 inch square.

Materials of the metal mesh include stainless steel, copper, iron, nickel, and brass. The weave of the metal mesh includes a plain weave, a twill weave, and an irregular weave. The mesh may be squashed (flattened), or the mesh may be plated with another metallic material. The difference in level between wires is preferably as small as possible. A mesh having no difference in level at the intersections which can be prepared by etching or punching is also useful.

It is preferable that the metal mesh is not completely buried under the surface of the PTC composition but be embedded with the upper portion of the mesh being uniformly exposed on the surface of the PTC composition as shown in FIG. 1(*b*). Thereafter, the surface comprising the PTC composition and the exposed metal mesh is preferably subjected to surface graining by mechanical abrasion with a sand blast, a sand paper, etc. or chemical abrasion with an acid to increase the exposed area of the mesh.

A metal layer is then formed on the metal mesh-embedded surface by chemical plating, electroplating, vacuum vapor phase deposition (vacuum evaporation or sputtering) or flame spray coating. The plating metal is not particularly limited and includes Ni, Cu, Ag, Sn, and Cr.

After an electrode composed of a metal mesh and a metal layer is formed on each side of the PTC composition, the stock sheet is worked into a desired size by punching or cutting, and a metallic lead wire is soldered to each electrode. If desired, the PTC thermistor may be encapsulated in an insulating resin, or a conductive adhesive may be applied to the electrode, via which an outer metallic terminal can be connected.

The organic PTC thermistors of the first and second embodiments of the invention are useful as an overcurrent preventive element in various small D.C. motors for driving door locks, outside mirror (door mirror) control, and power windows of automobiles; and secondary batteries, such as lithium batteries, nickel-hydrogen batteries, and nickel-cadmium batteries. They are also useful as an overcurrent preventive element in a radiofrequency current circuit as in an overheat preventive apparatus used in a back-lighting fluorescent tube. In particular, since the thermistors according to the first embodiment and those which are in accordance with the second embodiment and also use tungsten carbide as a conductive substance exhibit excellent resistance characteristics in the radiofrequency region, they are preferably used as an overcurrent preventive element in a radiofrequency current circuit as in an overheat preventive apparatus used in a back-lighting fluorescent tube.

The application of the thermistors of the invention to the radiofrequency current circuit as in a back-lighting fluorescent tube will be explained below in greater detail.

A back-lighting fluorescent tube for a liquid crystal display used in portable personal computers or word processors, etc. is generally made of a transparent material such as glass, the inner wall of which is coated with a fluorescent substance, and which is filled with gas for discharging. On applying an alternating or direct current to the electrodes positioned at each end of the tube, a discharge takes place through the gas. Ultraviolet rays having a wavelength of 253.7 nm excited by mercury gas irradiates the fluorescent substance on the inner wall of the tube and converted to visible light. The electrodes for this kind of fluorescent tubes include a hot cathode and a cold cathode. In the case of a hot cathode, if the arc discharge is changed to a glow discharge in the end of the life of the fluorescent tube, there is a tendency that the electrode portion abnormally generates heat, and the tube wall temperature, which is normally not higher than 100° C., rises up to around 200° C., which may lead to damage of the surrounding equipment including the liquid crystal.

As a countermeasure against the above phenomenon in the case where a hot cathode lamp is used as a back-light for liquid crystal displays, *Share Giho* (May, 1994) proposes to use a system in which a temperature fuse is brought into contact with the electrode side so that the circuit may be broken in case of abnormal heat generation. However, should the temperature fuse be cut in case of abnormal heat generation, the liquid crystal display gets out of use, and both the fluorescent tube and the temperature fuse have to be renewed.

Under the above circumstances, the PTC thermistor of the present invention which is capable of radiofrequency current control can be used as an overheat preventive element which is brought into thermal contact with a fluorescent tube, i.e., in intimate contact with the electrode portion of a fluorescent tube. In case of abnormal heat generation at the electrode portion, as the resistivity of the thermistor rises, the current passing through the circuit is limited, ultimately prolonging the life of the electrode. Thus, the thermistor of the invention provides a small, light, and economical overheat preventive apparatus for a fluorescent tube.

In a preferred mode of the apparatus, the electrode terminal of the thermistor and one electrode lead of the fluorescent tube are electrically connected, and the thermistor is integrated into the lighting circuit of the fluorescent tube with series connection. In another preferred mode of the apparatus, the thermistor forms a detecting circuit dependent of the lighting circuit of the fluorescent tube, and an increase of resistivity of the thermistor due to abnormal overheat of the fluorescent tube is detected.

Examples of the abnormal overheat preventive apparatus for a fluorescent tube in which the thermistor of the invention is used as a PTC element are shown below by referring to the accompanying drawings.

Figure 2A:
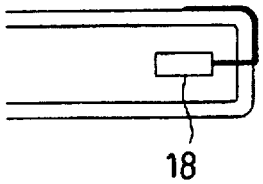
FIGS. 2(*a*), 2(*b*) and 2(*c*) show an example of an overheat preventive apparatus in which the PTC thermistor of the invention is used.
Figure 2B:
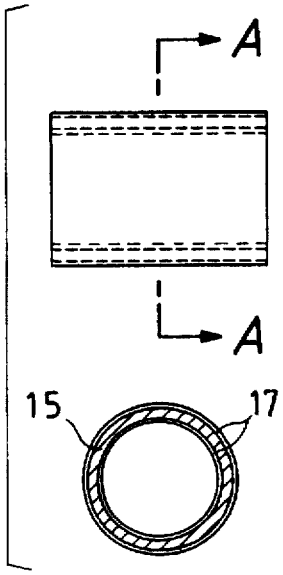
Figure 2C:
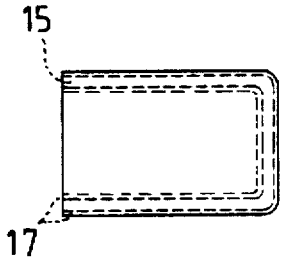
Figure 3:
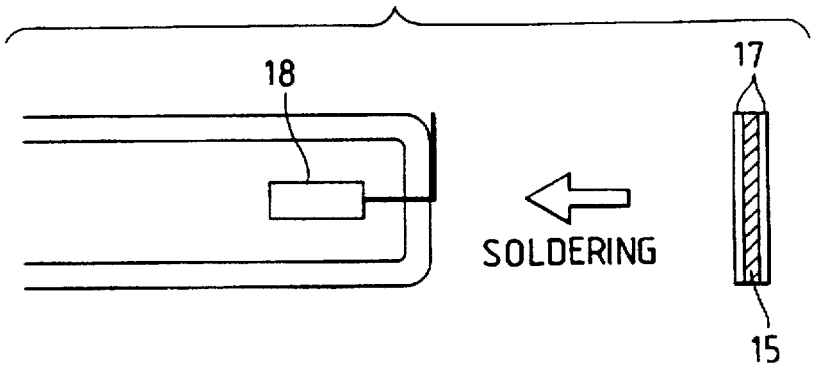
FIG. 3 shows another example of an overheat preventive apparatus in which the PTC thermistor of the invention is used.

FIG. 2 illustrates PTC thermistor 15 prepared by molding a PTC composition into a cylinder and forming electrodes 17 of Ni, Ag, etc., which is fitted into electrode 18 of a fluorescent tube. FIG. 3 illustrates PTC thermistor 15 prepared by forming a PTC composition into a disk followed by calcination, which is electrically connected to the terminal lead of a fluorescent tube by, for example, soldering. Either example is characterized in that the PTC thermistor is thermally in contact with the end of the electrode of a fluorescent tube. If desired, a heat shrinkable tube may be put on both the thermistor and the end of the fluorescent tube electrode in order to assure an intimate contact therebetween.

Figure 4:
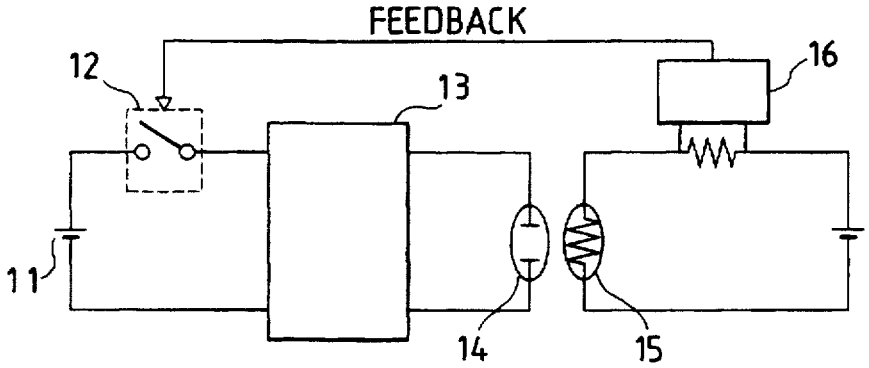
FIG. 4 is a detecting circuit diagram in which the PTC thermistor of the invention is used as a heat sensor.
Figure 5:
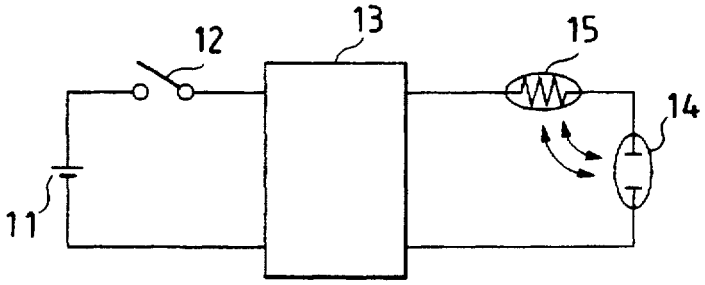
FIG. 5 is a circuit diagram in which the PTC thermistor is connected in series to the electrode of a fluorescent tube.

In case of abnormal overheat at the electrode of a fluorescent tube in the end of its life, the PTC thermistor shows an abrupt rise of resistivity, which can be detected in detecting circuit 16 (see FIG. 4). Where the PTC thermistor is connected in series to the electrode of fluorescent tube 14, the current passing through lighting circuit 13 of the fluorescent tube is limited according to the resistivity rise of the PTC thermistor so that the heat generation at the fluorescent tube electrode is suppressed, and the life of the fluorescent tube can be prolonged (see FIG. 5).

In FIGS. 2 to 5, numeral 11 denotes a DC power source and 12 denotes a switch.

Figure 6:
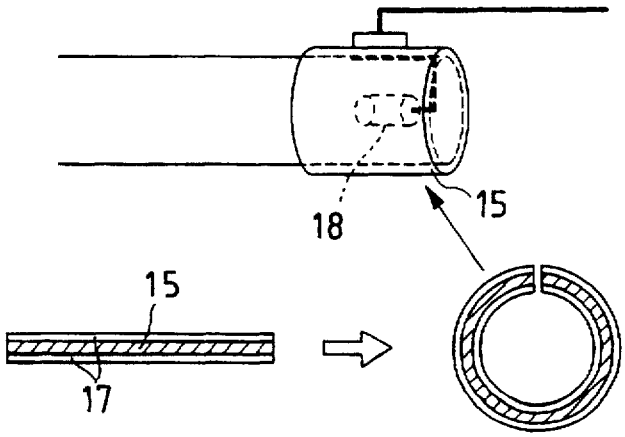
FIG. 6 shows a further example of an overheat preventive apparatus in which the PTC thermistor of the invention is used.

The PTC thermistor may be held by a holder so as to be removably fitted to the electrode portion of a fluorescent tube. Further, as shown in FIG. 6, PTC thermistor 15 in a sheet form may be wound around the end of a fluorescent tube.

Even when a fluorescent tube is near its end, it can be renewed before light is cut off, owing to the thermistor of the invention having PTC characteristics used as an abnormal overheat preventive apparatus. The PTC thermistor can be repeatedly reused. Since the PTC thermistor prevents abnormal heat generation at the electrode portion while an arc discharge is changed to a glow discharge in the end of the life of a fluorescent tube, it functions as a protection of the surrounding equipment including the liquid crystal against thermal damage.

Where the PTC thermistor is connected in series to a fluorescent tube lighting circuit, since the current is limited according as the resistivity of the thermistor rises due to abnormal heat generation, the life of the fluorescent tube can be extended. What happens when a fluorescent tube is coming to its end is mere darkening of the liquid crystal display screen, which visually teaches a user when to renew the fluorescent tube.

The present invention will now be illustrated in greater detail with reference to Examples in view of Comparative Examples, but it should be understood that the invention is not construed as being limited thereto. Unless otherwise indicated, all the parts are by weight.

EXAMPLE 1

In accordance with the description of JP-B-4-11575, 100 parts of PVDF (KYNAR 711, produced by Elf Atochem North America) was mixed with 10 parts of a silane coupling agent (KBC1003, produced by Shin-Etsu Chemical Co., Ltd.) and 1 part of 2,5-dimethyl-2,5-di(t-butylperoxy) hexyn-3, and the mixture was kneaded in a twin-screw extruder at 200° C. to prepare a grafted polymer.

WC powder (WC-F, produced by Nippon Shinkinzoku K.K.; average particle size: 0.65 μm) was added to the grafted polymer in a proportion of 20% by volume based on the resulting composition, and the mixture was kneaded in a kneading machine at 200° C. and 25 rpm for 1 hour to prepare a PTC composition. The PTC composition was hot pressed at 200° C. and 30 kgf/cm$^2$ to obtain a sheet having a thickness of about 1 mm.

A nickel foil, one surface of which was roughened, (available from Fukuda Metal Foil & Powder Co., Ltd.) was adhered to each side of the sheet with the roughened surface thereof being in contact with the sheet and press bonded at 200° C. and 30 kgf/cm$^2$, followed by allowing to cool at room temperature to form a pair of electrode layers. The sheet with electrodes was punched into a disk of 10 mm in diameter to obtain a PTC thermistor.

EXAMPLES 2 TO 4

PTC thermistors were prepared in the same manner as in Example 1, except for changing the amount of WC added to 25% by volume, 30% by volume, or 40% by volume, based on the resulting PTC composition.

EXAMPLES 5 TO 8

PTC thermistors were prepared in the same manner as in Example 2, except for using WC powder having an average particle size of 2.09 μm (WC-25, produced by Nippon Shinkinzoku K.K.), 4.82 μm (WC-50, produced by Nippon Shinkinzoku K.K.), 8.60 μm (WC-90, produced by Nippon Shinkinzoku K.K.), or 75 μm (WC-S, produced by Nippon Shinkinzoku K.K.).

EXAMPLE 9

A PTC thermistor was prepared in the same manner as in Example 2, except for replacing KYNAR 711 with KYNAR 461, PVDF produced by the same manufacturer. KYNAR 461 and KYNAR 711 are different in melt viscosity. The viscosity of KYNAR 461 is 28,000 poise while that of KYNAR 711 is 7,000 poise, both as measured with a Monsant Capillary Viscometer at 230° C.

EXAMPLE 10

A hundred parts of polyethylene (hereinafter abbreviated as PE) (HiZex 2100P, produced by Mitsui Petrochemical Industries, Ltd.) were mixed with 10 parts of a silane coupling agent (KBE1003, produced by Shin-Etsu Chemical Co., Ltd.) and 1 part of dicumyl peroxide (DCP), and the mixture was kneaded in a twin-screw extruder at 140° C. to prepare a graft polymer.

A PTC thermistor was prepared in the same manner as in Example 2, except for using the above-prepared graft polymer and setting the kneading temperature at 140° C.

EXAMPLE 11

A hundred parts of an ethylene-vinyl acetate copolymer (hereinafter abbreviated as EVA) (LV140, produced by Mitsubishi Kagaku K.K.) were mixed with 10 parts of a silane coupling agent (KBE1003) and 1 part of DCP, and the mixture was kneaded in a twin-screw extruder at 120° C. to prepare a graft polymer.

A PTC thermistor was prepared in the same manner as in Example 2, except for using the above-prepared graft polymer and setting the kneading temperature at 120° C.

EXAMPLE 12

PTC thermistor was prepared in the same manner as in Example 3, except for using WC powder having an average particle size of from 0.1 to 0.2 μm (WC02N, produced by Tokyo Tungsten Co., Ltd.).

COMPARATIVE EXAMPLES 1 TO 8

PTC thermistors were prepared in the same manner as in Example 1, except for changing the kind and/or the amount of the conductive powder as follows.

Comparative Example 1

Titanium nitride TiN (TiN-01 produced by Nippon Shinkinzoku K.K.; average particle size: 1.37 μm), added in an amount of 30 vol % (based on the resulting PTC composition; hereinafter the same).

Comparative Example 2

Zirconium nitride ZrN (ZrN, produced by Nippon Shinkinzoku K.K.; average particle size: 1.19 μm), added in an amount of 30 vol %.

Comparative Example 3

Titanium carbide TiC (TiC-007, produced by Nippon Shinkinzoku K.K.; average particle size: 0.88 μm), added in an amount of 40 vol %.

Comparative Example 4

Titanium boride $TiB_2$ ($TiB_2$-PF, produced by Nippon Shinkinzoku K.K.; average particle size: 1.80 μm), added in an amount of 30 vol %.

Comparative Example 5

Molybdenum silicide $MoSi_2$ ($MoSi_2$-F, produced by Nippon Shinkinzoku K.K.; average particle size: 1.60 μm), added in an amount of 40 vol %.

Comparative Example 6

Nickel Ni (filamentous Ni powder #210, produced by INCO; average particle size: 0.5 to 1.0 μm), added in an amount of 25 vol %.

Comparative Example 7

Carbon black (CB) (Toka Black #4500, produced by Tokai Carbon Co., Ltd.), added in an amount of 30 vol %.

Comparative Example 8

Tungsten carbide WC (WC-F) added in an amount of 18 vol %.

Each of the PTC thermistors prepared in Examples 1 to 12 and Comparative Examples 1 to 8 were evaluated by measuring the following characteristics. The results obtained are shown in Tables 1 to 3 below. The compositions of the PTC compositions used in the thermistors are also shown in the tables.

1) $R_{25}$

Surface resistivity at 25° C. as measured by a four-terminal method.

2) $\rho_{25}$

Volume resistivity calculated from $R_{25}$ and main surface area S and thickness t of the PTC composition (exclusive of the electrodes) according to equation:

$$\rho_{25}=R_{25}\times(S/t)$$

3) $R_{85}/R_{25}$

Ratio of surface resistivity at 85° C. to surface resistivity at 25° C.

4) $H_p$

Index indicative of the degree of PTC characteristics, expressed in terms of ratio (number of figures) of maximum volume resistivity $\rho_{max}$ to $\rho_{25}$, which is obtained by the following equation, taken as a rate of resistivity change.

$$H_p = \log(\rho_{max}/\rho_{25})$$

5) $V_b$

Breakdown voltage measured by monitoring the current while gradually increasing the voltage and reading the voltage at the point when the sheet of the PTC composition sparked or melted.

TABLE 3-continued

| Example No. | $\rho_{25}$ (Ω · cm) Initial | After 3 ρ-T Cycles | Rate of Change % |
|---|---|---|---|
| Comparative Example 6 | 0.07 | 0.72 | +928.6 |
| Comparative Example 7 | 1.35 | 1.59 | +17.7 |

Comparison with Other Ceramic Powders

As is apparent from comparison between Examples of Table 1 and Comparative Examples of Table 2, the samples using a conductive ceramic powder other than WC

TABLE 1

| Example No. | Organic Polymer | Conductive Substance: Kind | Average Particle Size (μm) | Volume Resistivity (Ω · cm) | Amount Added (vol %) | Characteristics of Organic PTC Thermistor: $R_{25}$ (Ω) | $\rho_{25}$ (Ω · cm) | $R_{85}/R_{25}$ | $H_p$ | $V_b$ (V) |
|---|---|---|---|---|---|---|---|---|---|---|
| 1 | PVDF (KYNAR 711) | WC-F | 0.65 | $19 \times 10^{-6}$ | 20 | 7.71 | 72.1 | 20.3 | 6.1 | >200 |
| 2 | " | " | " | " | 25 | 0.09 | 0.85 | 1.77 | 8.7 | >200 |
| 3 | " | " | " | " | 30 | 0.007 | 0.09 | 2.00 | 8.4 | >200 |
| 4 | " | " | " | " | 40 | 0.002 | 0.017 | 2.50 | 8.1 | >200 |
| 5 | " | WC-25 | 2.09 | " | 25 | 0.1 | 0.92 | 5.45 | 9.1 | >200 |
| 6 | " | WC-50 | 4.82 | " | 25 | 0.46 | 8.50 | 5.38 | 7.2 | 180 |
| 7 | " | WC-90 | 8.60 | " | 25 | 1.20 | 15.2 | 6.58 | 6.7 | 180 |
| 8 | " | WC-S | 75 | " | 25 | 2.69 | 22.4 | 30.3 | 6.8 | 10 |
| 9 | PVDF (KYNAR 461) | WC-F | 0.65 | " | 25 | 0.121 | 0.95 | 3.60 | 8.0 | >200 |
| 10 | PE (HiZex2100P) | " | 0.65 | " | 30 | 0.007 | 0.09 | 1.61 | 10.6 | >200 |
| 11 | EVA (LV140) | " | " | " | 30 | 0.025 | 0.47 | — | 10.1 | >200 |
| 12 | PVDF (KYNAR 711) | WC02N | 0.11 | " | 25 | 0.04 | 0.68 | 1.86 | 6.9 | >200 |

TABLE 2

| Comparative Example No. | Organic Polymer | Conductive Substance: Kind | Average Particle Size (μm) | Volume Resistivity (Ω · cm) | Amount Added (vol %) | Characteristics of Organic PTC Thermistor: $R_{25}$ (Ω) | $\rho_{25}$ (Ω · cm) | $R_{85}/R_{25}$ | $H_p$ | $V_b$ (V) |
|---|---|---|---|---|---|---|---|---|---|---|
| 1 | PVDF (KYNAR 711) | TiN-01 | 1.37 | $40 \times 10^{-6}$ | 30 | >200 M | — | — | — | — |
| 2 | " | ZrN | 1.19 | $18 \times 10^{-6}$ | 30 | >200 M | — | — | — | — |
| 3 | " | TiC-007 | 0.88 | $61 \times 10^{-6}$ | 40 | 84.4 | 985 | 24.6 | 6.0 | >200 |
| 4 | " | $TiB_2$-PF | 1.80 | $9 \times 10^{-6}$ | 30 | >200 M | — | — | — | — |
| 5 | " | $MoSi_2$-F | 1.60 | $21.6 \times 10^{-6}$ | 40 | >200 M | — | — | — | — |
| 6 | " | Ni#210 | 0.5–1.0 | $6.6 \times 10^{-6}$ | 25 | 0.005 | 0.07 | 1.00 | 8.6 | 130 |
| 7 | " | CB#4500 | 40 nm | $2 \times 10^{-1}$ | 30 | 0.16 | 1.35 | 1.38 | 4.6 | >200 |
| 8 | " | WC-F | 0.65 | $19 \times 10^{-8}$ | 18 | 319 k | 2.93 M | — | — | >200 |

TABLE 3

| Example No. | $\rho_{25}$ (Ω · cm) Initial | After 3 ρ-T Cycles | Rate of Change % |
|---|---|---|---|
| Example 3 | 0.09 | 0.11 | +22.2 |

Figure 10:
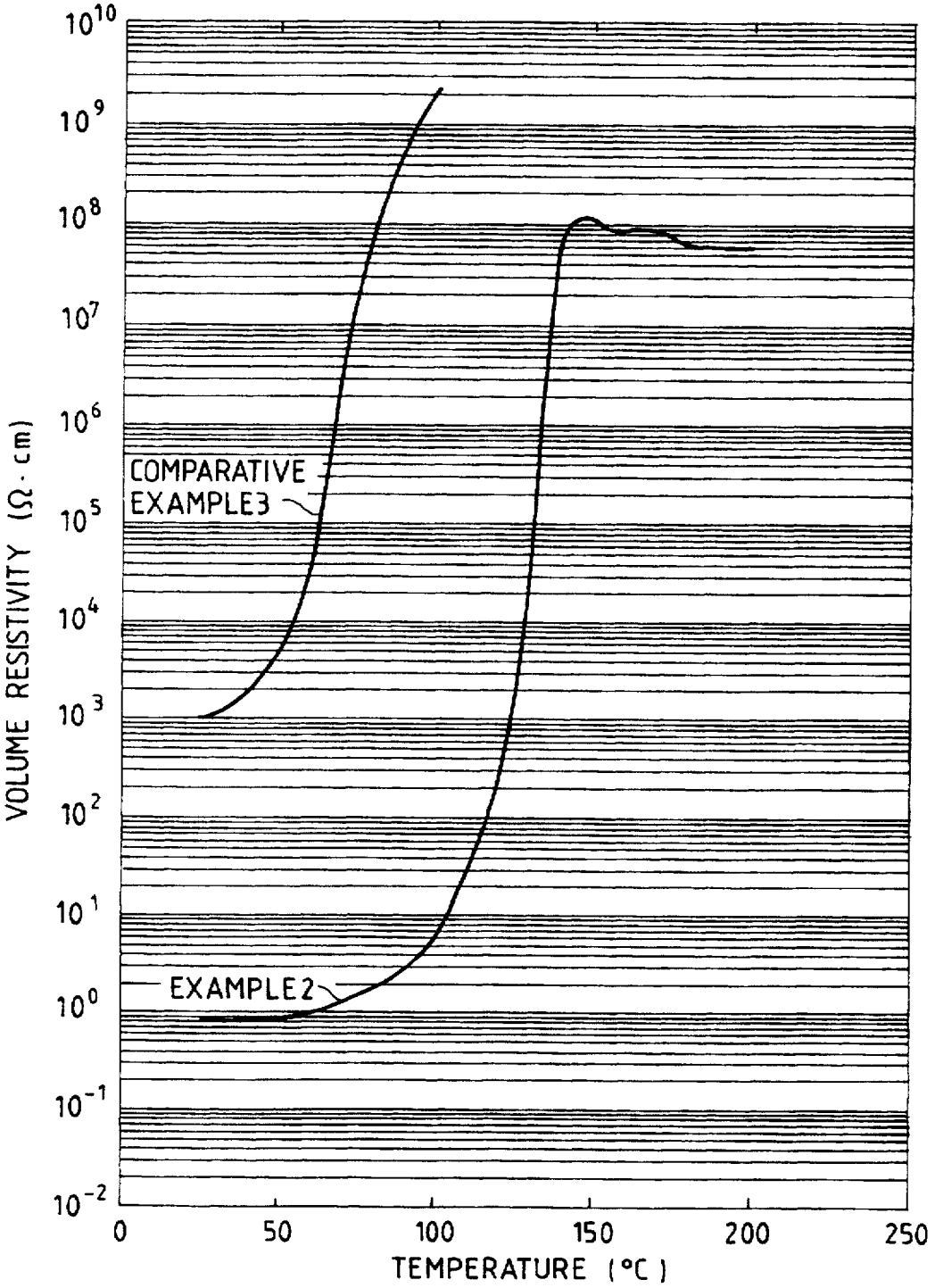
FIG. 10 is a graph showing ρ-T characteristics observed with conductive powder WC in comparison with those observed with TiC.

(Comparative Examples 1 to 5 except Comparative Example 3 using TiC) have an extremely high surface resistivity almost like an insulator whether the conductive powder content is increased to 30 vol % or 40 vol %. The sample of Comparative Example 3 using TiC, although added in an amount increased to 40 vol %, has as high a volume resistivity as 985 Ω•cm. To the contrary, the resistivity of those samples using WC is by far lower even when the amount of WC added is as small as 23 vol %. In FIG. 10 is shown the volume resistivity (ρ) vs. temperature (T) characteristics of the sample containing 25 vol % of WC (Example 2) and that containing 40 vol % of TiC (Comparative Example 3).

WC Content

Figure 7:
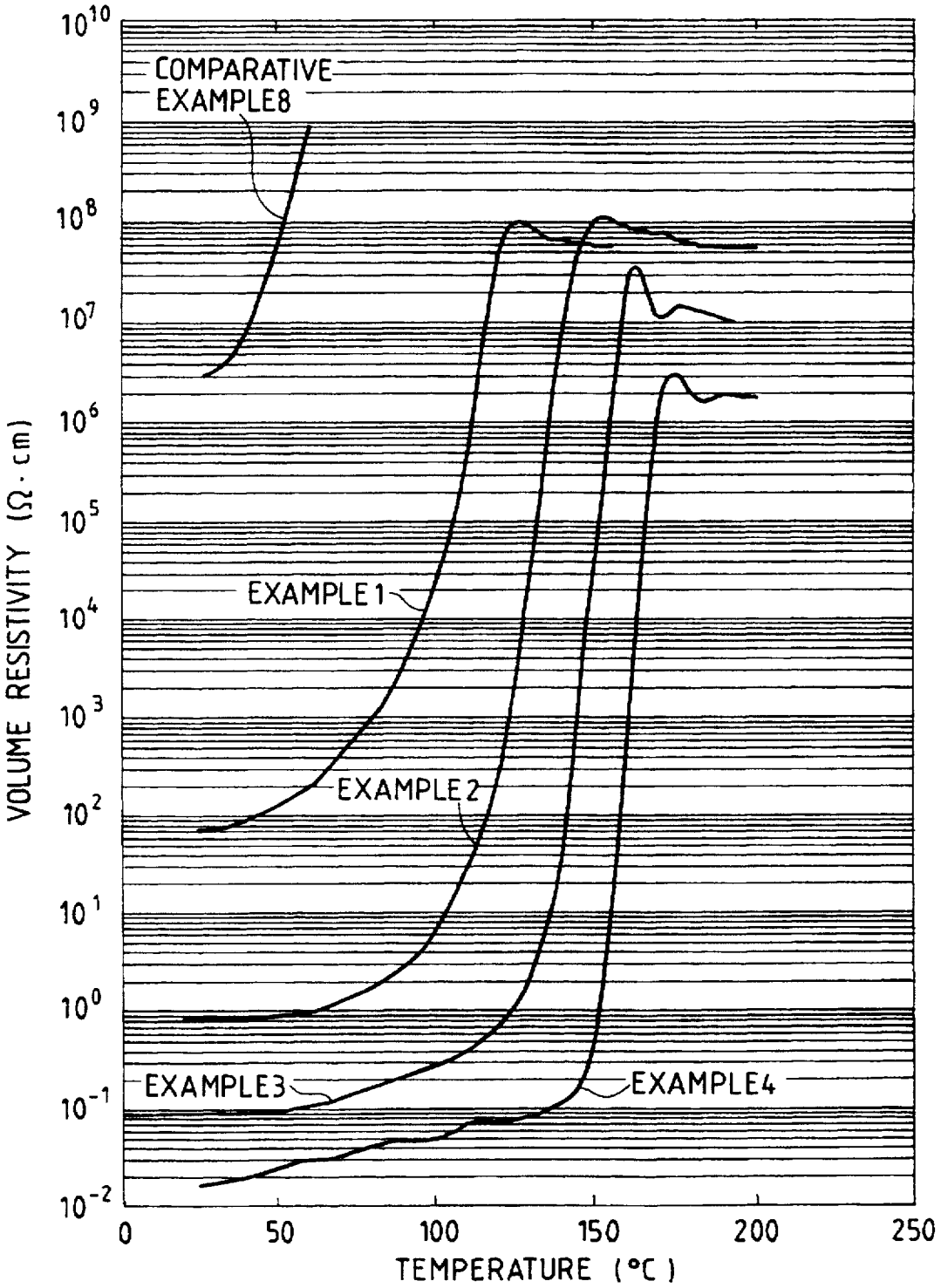
FIG. 7 is a graph showing volume resistivity-temperature (ρ-T) characteristics dependent on the tungsten carbide (WC) content in a polyvinylidene fluoride (PVDF) composition.

FIG. 7 shows the ρ-T characteristics of Examples 1 to 4 and Comparative Example 8. As is seen from the graph of FIG. 7 and the results in Table 1, the room temperature surface resistivity exceeds 300 MΩ at a WC content of 18 vol %, which is too high for practical use. A preferred WC content for securing practical utility is 23 vol % or more, and the room temperature surface resistivity becomes lower as the WC content increases. On the other hand, the kneading torque becomes greater as the WC content increases. While not shown in FIG. 7 or Table 1, it has been proved that kneading and molding become difficult if the WC content exceeds 50 vol %. Therefore, a preferred amount of WC to be added ranges from 20 to 50 vol %, more preferably from 23 to 50 vol %, still preferably from 25 to 40 vol %, based on the PTC composition.

Average Particle Size

Figure 8:
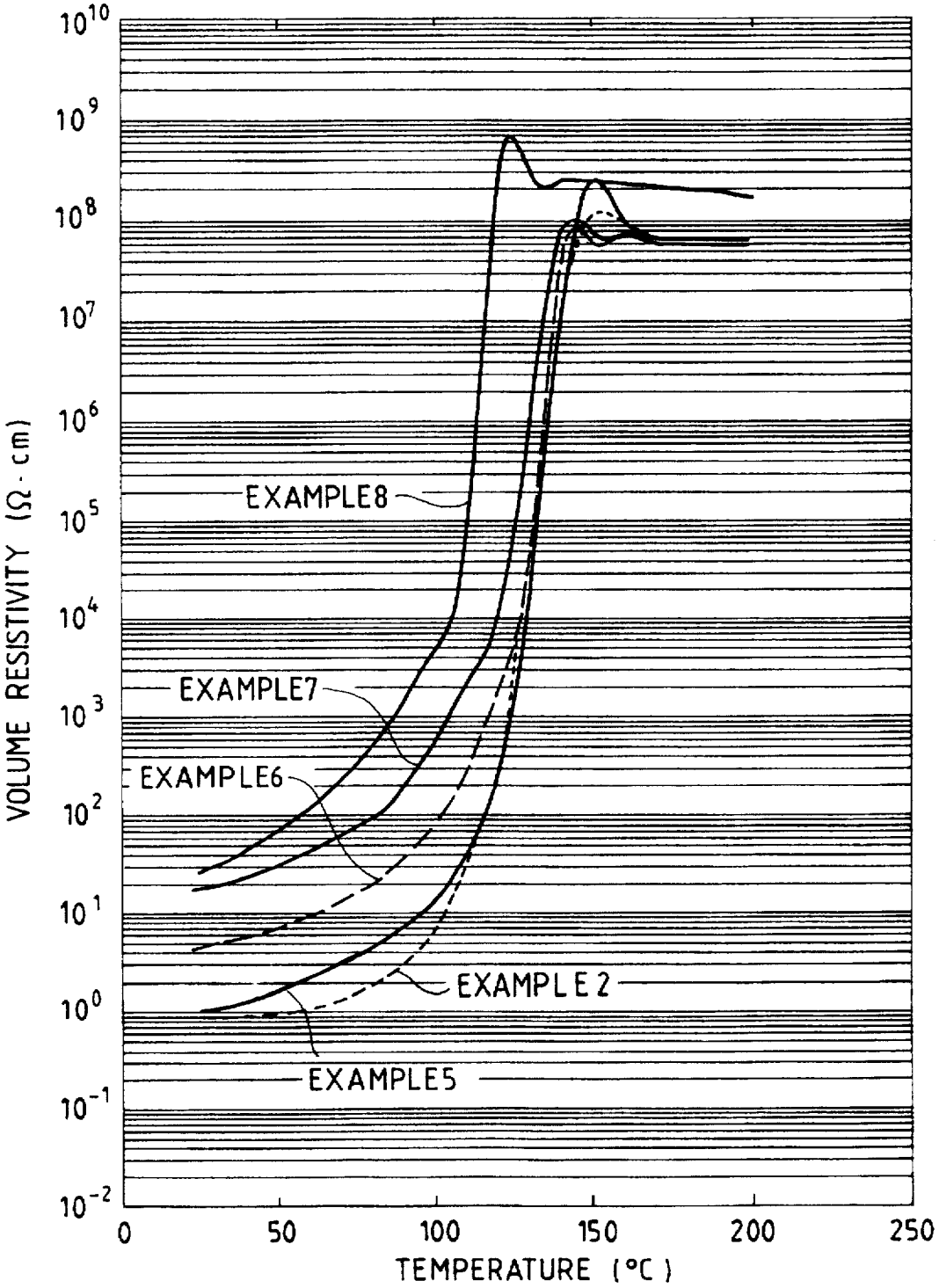
FIG. 8 is a graph showing ρ-T characteristics dependent on the average particle size of WC in a PVDF composition.

FIG. 8 is a graph showing ρ-T characteristics dependent on the average particle size of WC. As is seen from the data of Examples 2, 5 to 8, and 12 and FIG. 8, the room temperature surface resistivity increases as the average particle size of WC increases. If the average particle size is too large, increase of instability of resistivity is observed. It was revealed that if the average particle size exceeds 50 μm as in Example 8, the breakdown voltage $V_b$ becomes seriously low. In order to ensure a high breakdown voltage of 180 V or more, it is preferable that WC has an average particle size of not more than 10 μm as is apparent from the results of Examples 1 to 7. Further, as shown in Examples 1 to 4, with the WC average particle size being 1 μm or less, an increase of WC content from 25 vol % to 30 vol % results in reduction of resistivity by one or more figures and yet gives no adverse influence on the rate of resistivity change $H_p$ or breakdown voltage $V_b$. Accordingly, a still preferred average particle size of WC is not greater than 1 μm.

Figure 9:
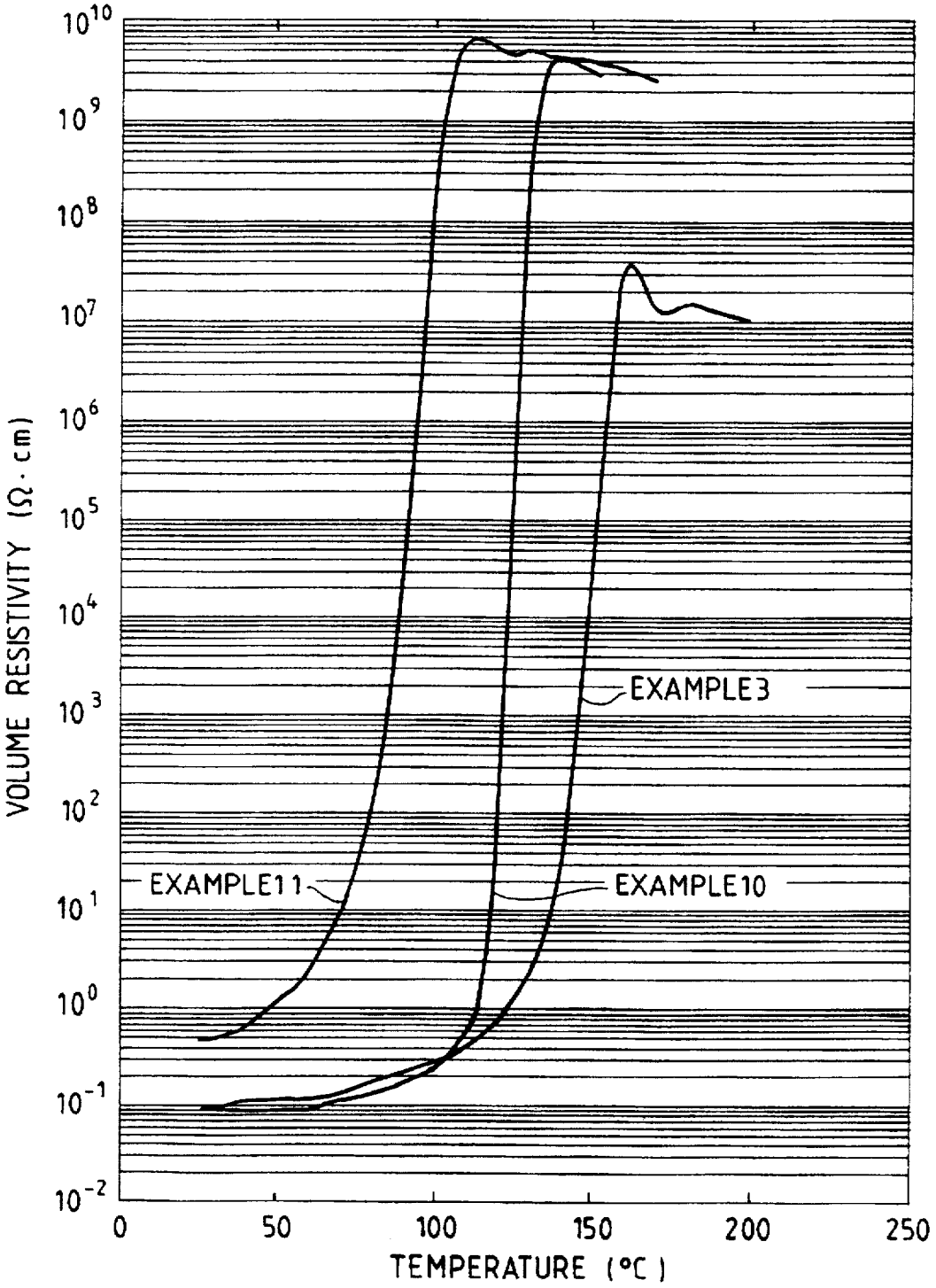
FIG. 9 is a graph showing ρ-T characteristics of PTC observed with various organic polymers.

WC powder having an average particle size smaller than 0.1 μm is not only expensive but causes an increase in kneading torque and makes kneading difficult, so that a preferred average particle size is 0.1 μm or greater. Where the average particle size is as small as is preferred, the same performance as described above can be assured even if the kind of PVDF is altered as in Example 9 or if PVDF is replaced with other organic polymers, such as PE or EVA, as shown in Table 1 and FIG. 9. It was confirmed in these cases that an increase in WC average particle size results in the same tendencies as to breakdown voltage, resistivity, and resistivity stability as observed with PVDF.

Comparison with Ni Powder

Figure 11:
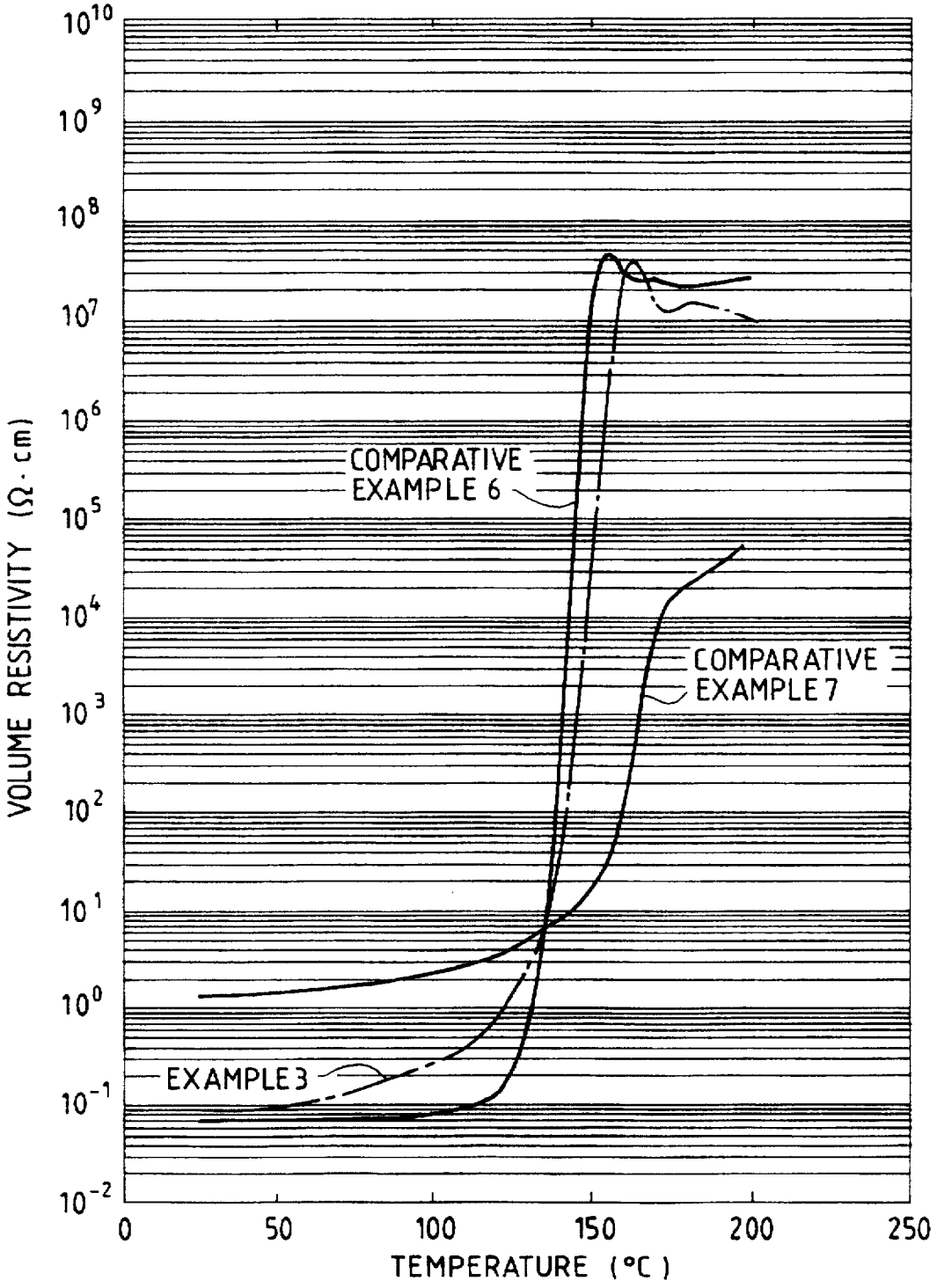
FIG. 11 is a graph showing ρ-T characteristics observed with conductive powder WC in comparison with those observed with Ni or carbon black.
Figure 12:
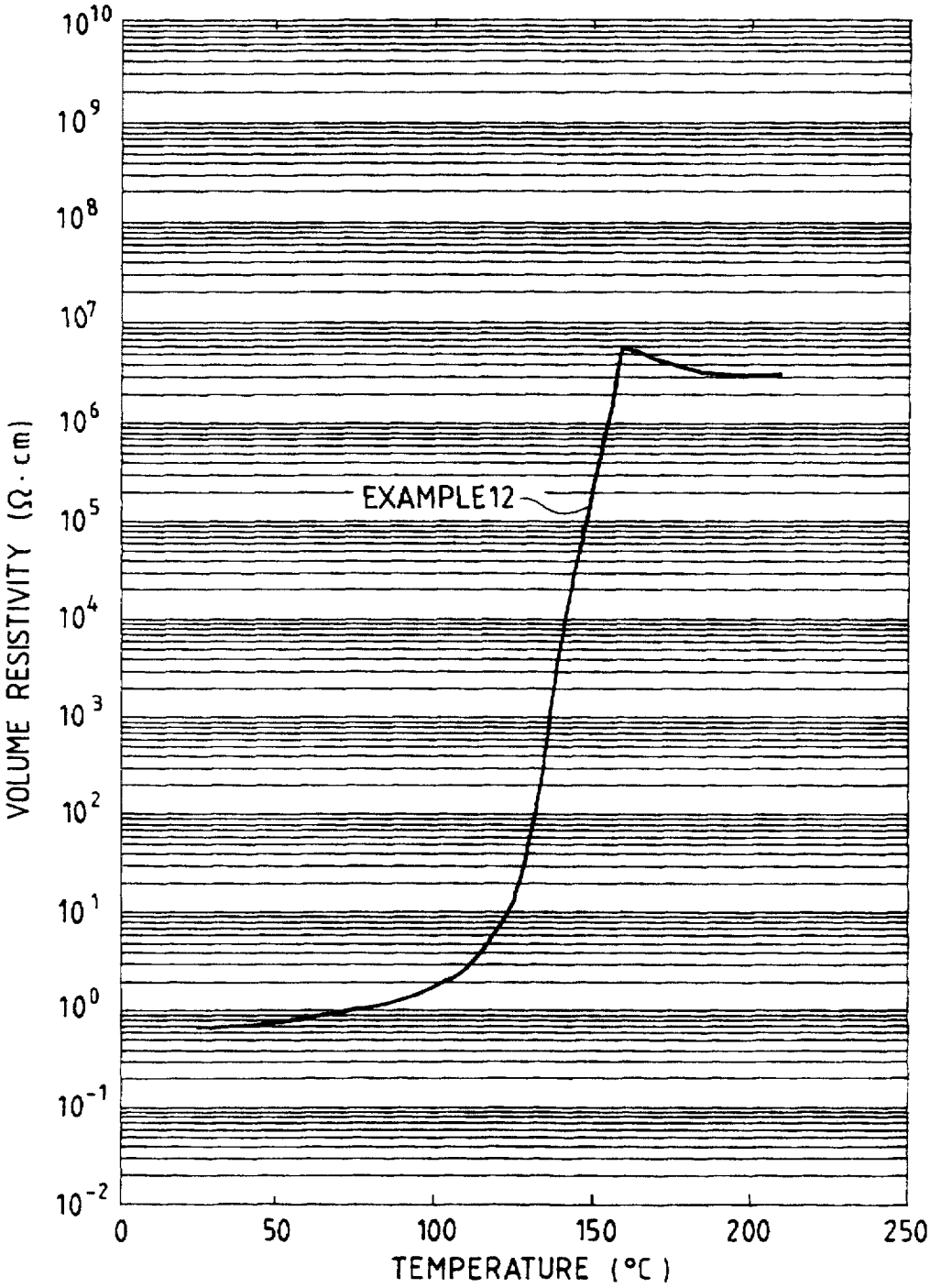
FIG. 12 is a graph showing representative ρ-T characteristics when fine conductive powder WC having an average diameter of from 0.1 to 0.2 μm.

FIG. 11 is a graph showing ρ-T characteristics observed with WC in comparison with those observed with Ni or CB. As is seen from FIG. 11 and the data of Comparative Example 6, the sample using Ni powder as a conductive substance is equal to WC-containing samples in terms of initial room temperature resistivity and rate of resistivity change but has a low breakdown voltage ($V_b$=130 V). The Ni-containing sample was also found inferior in heat resistance and reliability, such as repeatability. That is, as shown in Table 3, when samples were subjected to 3 thermal cycles for the measurement of ρ-T characteristics (from room temperature to 200° C.), the rate of the initial room temperature volume resistivity ($\rho_{25}$) to that after the thermal history was about 22% in Example 3, whereas that of Comparative Example 6 using Ni was as high as about +900% or more, indicating poor repeatability.

Comparison with CB

In Comparative Example 7 in which CB is used as a conductive substance, the rate of change in $\rho_{25}$ after 3 ρ-T cycles was about 18% as shown in Table 3, which is not so different from the result of Example 2. However, as is seen from Table 2 and FIG. 11, the CB-containing sample shows such tendencies that the initial room temperature resistivity is higher than that of the Ni- or WC-containing sample by one or more figures and that the rate of resistivity change $H_p$ is lowered by about 4 figures. An increase in CB content in an attempt to lower the room temperature resistivity could not achieve the level of the Ni- or WC-containing samples; on the contrary a further reduction in rate of resistivity change $H_p$ was brought about.

EXAMPLE 13

A sheet of a PTC composition was prepared in the same manner as in Example 1, except for increasing the WC content to 30 vol %.

A stainless steel-made plain weave mesh having an opening size of 200 mesh was embedded on each side of the sheet at 200° C. under a load of 30 kgf/cm$^3$. After allowing to cool to room temperature, both sides of the sheet was electroless-plated with Ni to a thickness of 1 to 2 μm. The sheet was punched into a disk having a diameter of 10 mm to obtain a PTC element.

EXAMPLE 14

A PTC element was prepared in the same manner as in Example 13, except that the each surface of the sheet before Ni plating, with the mesh embedded in, was abraded with a sand paper to increase the exposed area of the mesh.

EXAMPLE 15

A PTC element was prepared in the same manner as in Example 13, except that Ni electroless plating was replaced with vacuum evaporation of Cu at a chamber temperature of 160° C. to form a Cu layer having a thickness of 1 to 2 μm.

EXAMPLE 16

A PTC element was prepared in the same manner as in Example 15, except that the each surface of the sheet before Cu deposition, with the mesh embedded in, was abraded with a sand paper to increase the exposed area of the mesh.

EXAMPLE 17

A PTC element was prepared in the same manner as in Example 15, except for changing the opening size of the mesh to 400 mesh.

EXAMPLE 18

A PTC element was prepared in the same manner as in Example 15, except for replacing the mesh having an opening size of 200 mesh with a stainless steel-made mesh having an opening size of 400 mesh and having no difference in level at the intersections.

REFERENCE EXAMPLE 1

A PTC element was prepared in the same manner as in Example 13, except that each electrode was formed only by Ni plating without using the metal mesh.

REFERENCE EXAMPLE 2

A PTC element was prepared in the same manner as in Example 13, except that Ni plating was not conducted.

REFERENCE EXAMPLE 3

A PTC element was prepared in the same manner as in Example 15, except that each electrode was formed only by Cu vacuum evaporation without using the metal mesh.

Each of the PTC elements obtained in Examples 12 to 17 and Reference Examples 1 to 3 was evaluated as follows. The results obtained are shown in Table 4 and FIGS. 12 through 15.

1) Initial Surface Resistivity

Measured by a four-terminal method.

2) Adhesion of Electrode

An adhesive tape (T4000, produced by Sony Chemical Co., Ltd.) was adhered to the entire surface of the electrode and rapidly stripped off. The adhesion of the electrode was judged by whether or not the electrode was peeled.

3) R-T Characteristics

The surface resistivity-temperature (R-T) characteristics were measured in a temperature range of room temperature (25° C.) to 200° C. After the measurement, the sheet was observed to see whether any deformation or development of wrinkles or cracks occurred.

TABLE 4

| Example No. | Initial Resistivity (Ω) | Adhesion | Deformation | Mesh Size | Abrasion | Deposition |
|---|---|---|---|---|---|---|
| Ex. 13 | 0.145 | not peeled | not observed | #200 | none | Ni plating |
| Ex. 14 | 0.079 | " | " | " | done | |
| Ex. 15 | 0.060 | " | " | " | none | Cu Vacuum evaporation |
| Ex. 16 | 0.031 | " | " | " | done | " |
| Ex. 17 | 0.063 | " | " | #400 | none | " |
| Ex. 18 | 0.029 | " | " | " | " | " |
| Ref. Ex. 1 | 0.200 | peeled | observed | — | " | Ni plating |
| Ref. Ex. 2 | 0.675 | not tested | not observed | #200 | " | none |
| Ref. Ex. 3 | 0.090 | not peeled | observed | — | " | Cu Vacuum evaporation |

Figure 16:
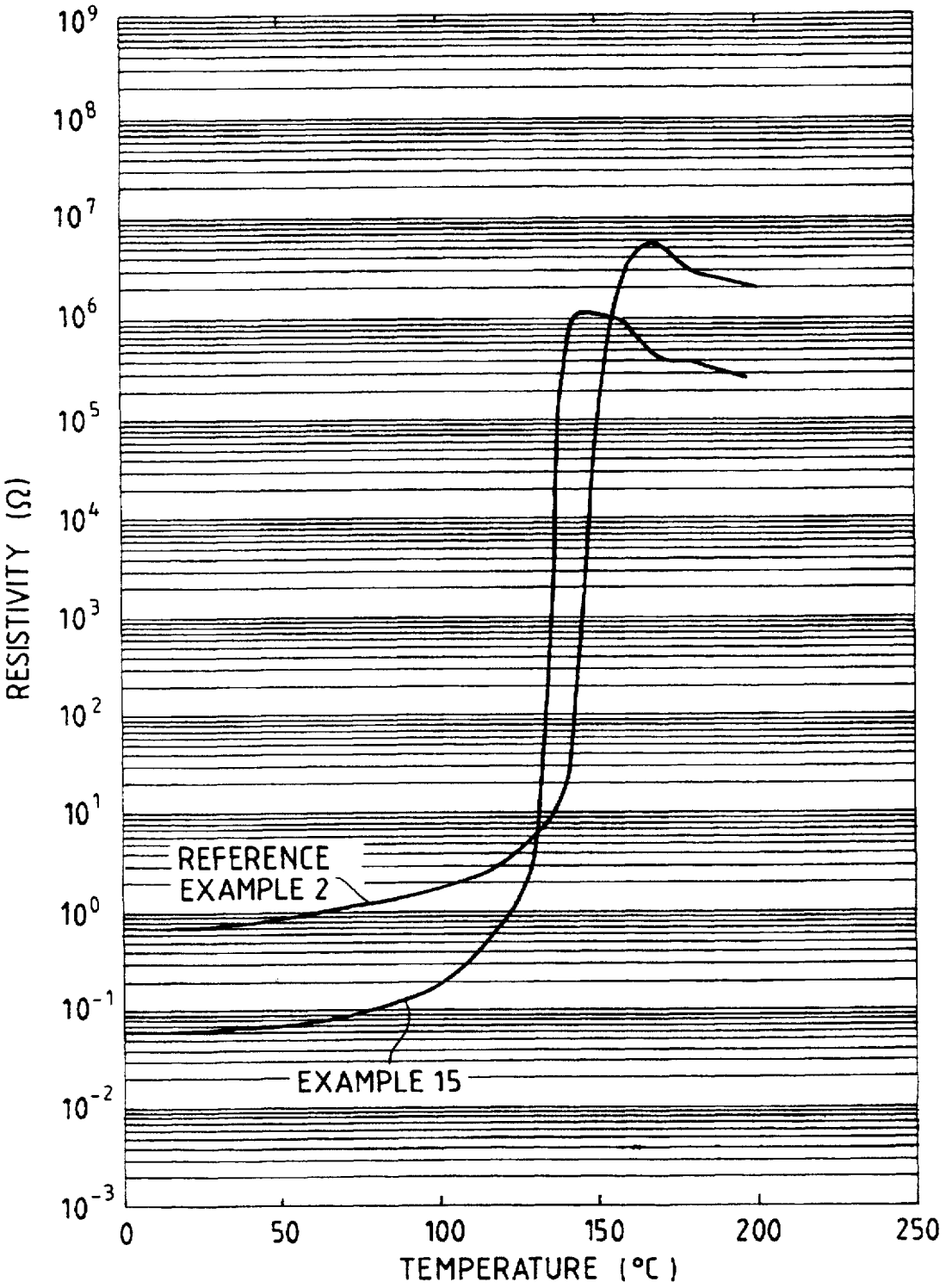
FIG. 16 is a graph showing R-T characteristics observed in Examples 15 and Reference Example 2.

It is seen that the PTC elements whose electrodes had been formed by plating or vacuum evaporation only (Reference Examples 1 and 3) showed weak adhesion between the electrode and the PTC sheet and had a high initial resistivity. The element whose electrodes had been formed only by embedding a metal mesh (Reference Example 2) showed improvement in mechanical strength over those of Reference Examples 1 and 3 but had a high initial resistivity and was instable as shown in FIG. 16.

On the other hand, it was proved that the electrode structure formed by embedding a metal mesh followed by plating or vacuum evaporation is effective to reduce the initial resistivity while relaxing the stress due to thermal stress thereby enhancing mechanical strength of the PTC sheet and the electrodes and preventing deformation or development of cracks, etc. (Examples 13, 15, and 17).

Figure 13:
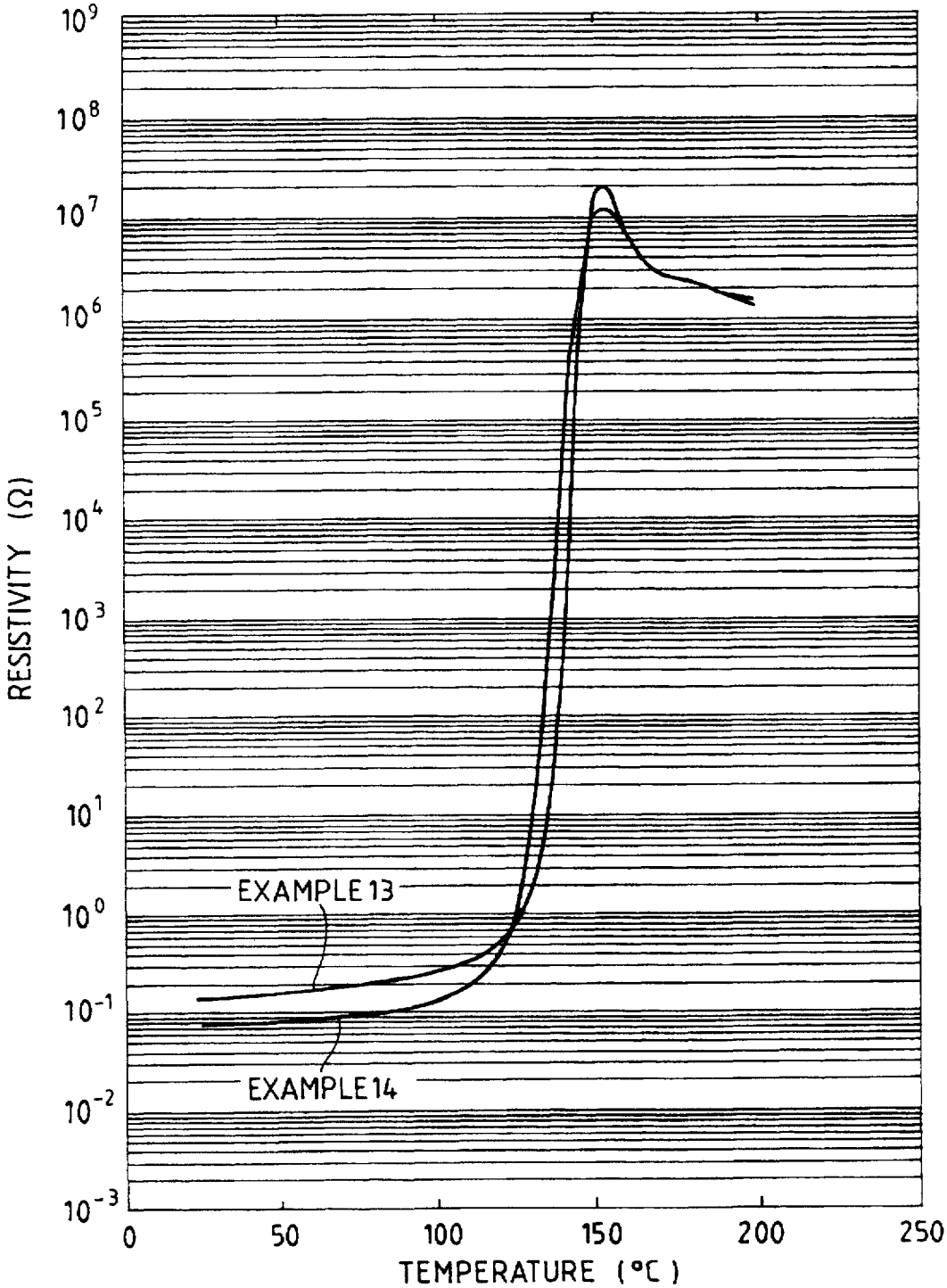
FIG. 13 is a graph showing surface resistivity-temperature characteristics (R-T characteristics) observed in Examples 13 and 14.
Figure 14:
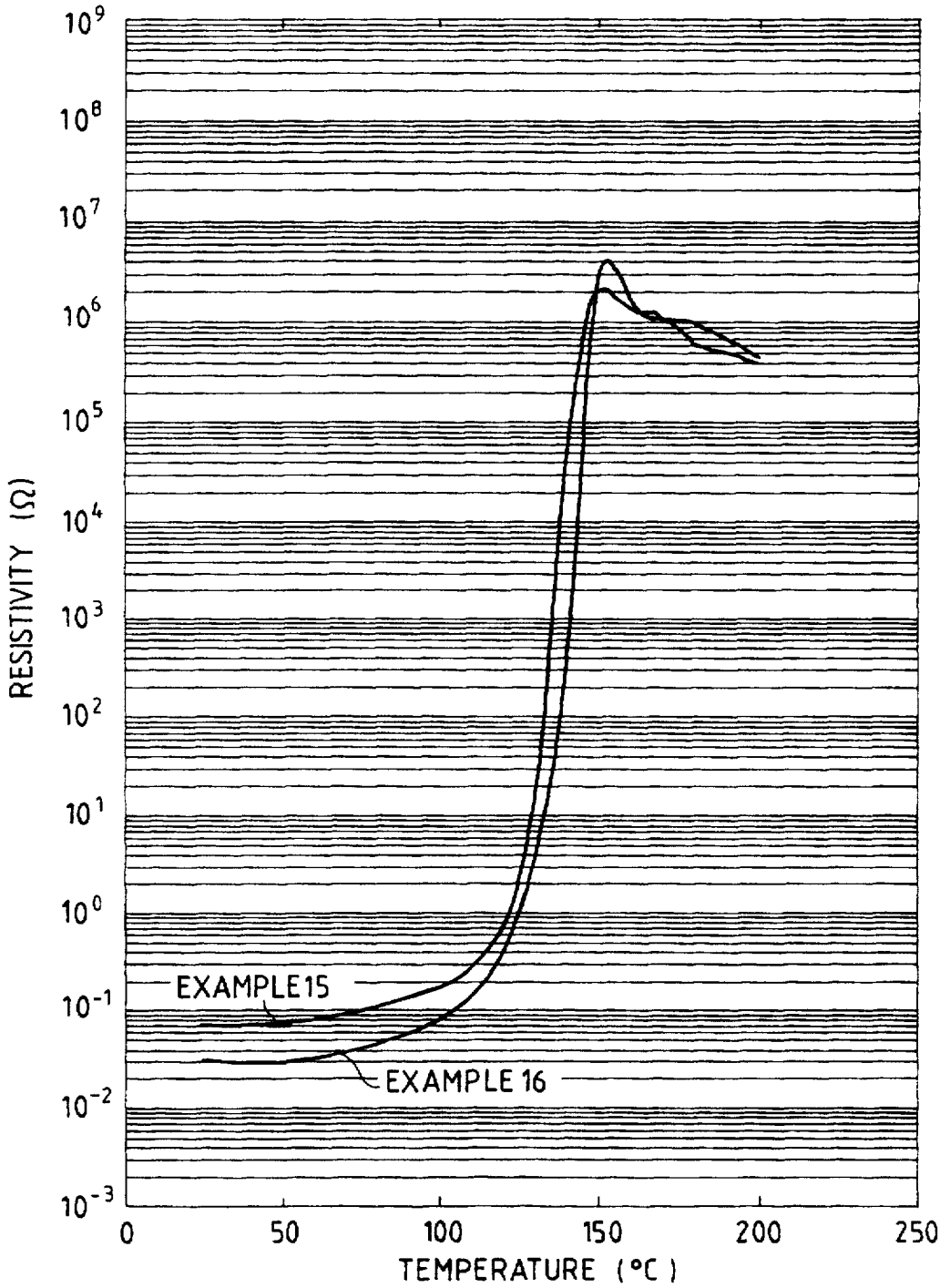
FIG. 14 is a graph showing R-T characteristics observed in Examples 15 and 16.
Figure 15:
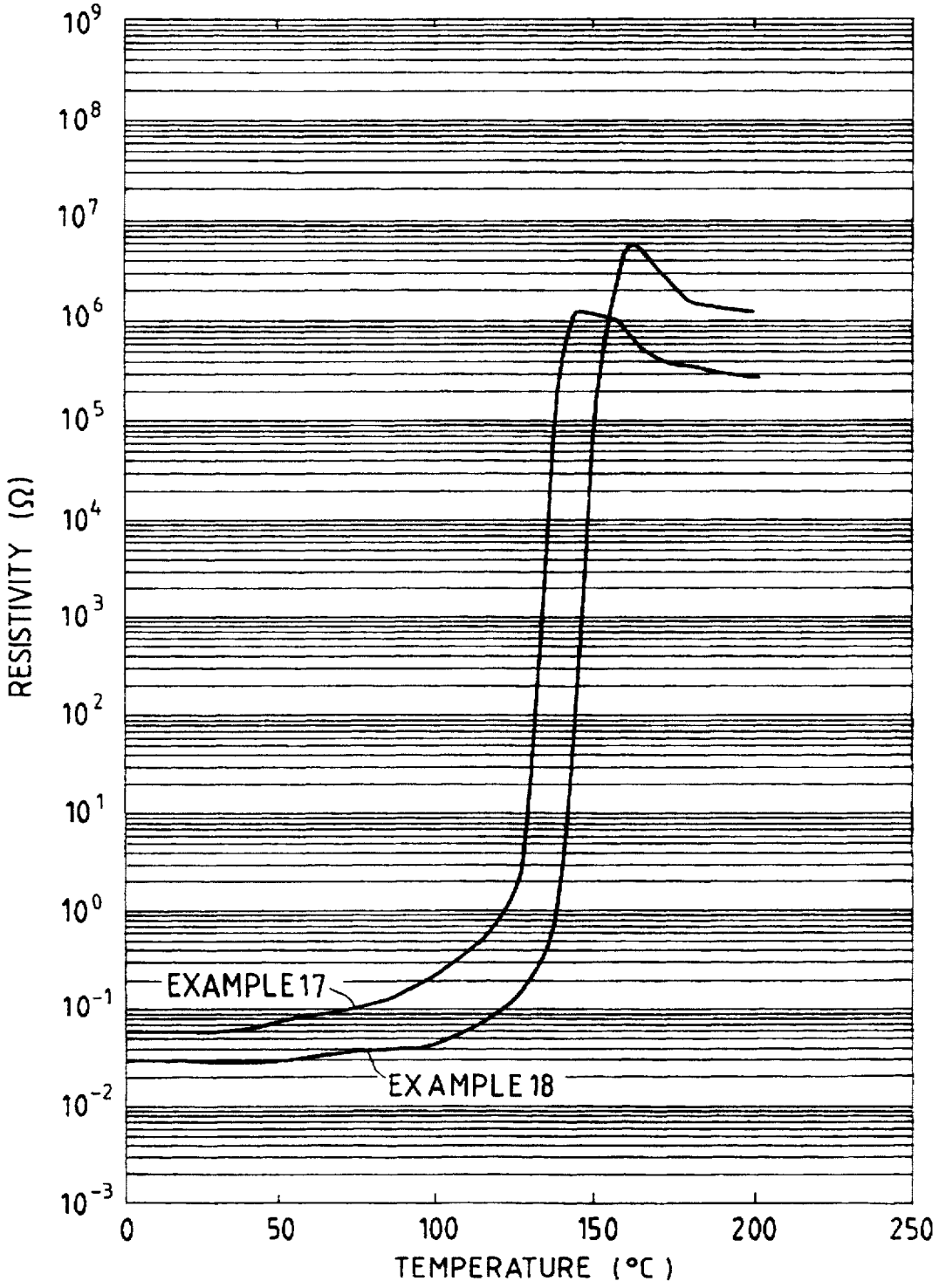
FIG. 15 is a graph showing R-T characteristics observed in Examples 17 and 18.

These effects can further be enhanced by using a metal mesh with no difference in level at the intersections (Example 18) or abrading both the embedded metal mesh and the PTC sheet to increase the exposed area of the mesh and the conductive particles in the PTC composition (Examples 14 and 16). In these cases, the initial surface resistivity can be lowered as shown in FIGS. 13 through 15.

Figure 17A:
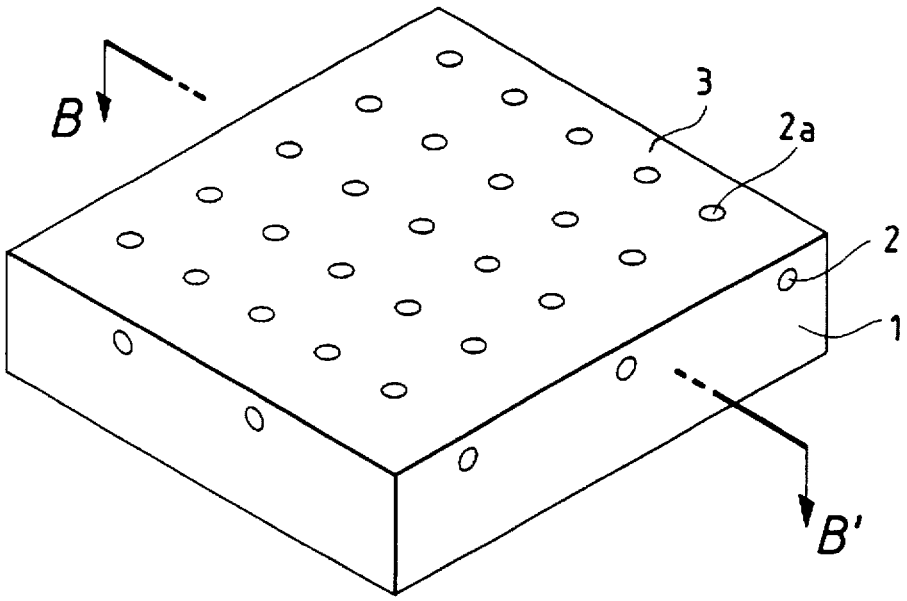
FIG. 17(a) (PRIOR ART)
FIGS. 17(*a*) and 17(*b*) show a conventional PTC thermistor.
Figure 17B:
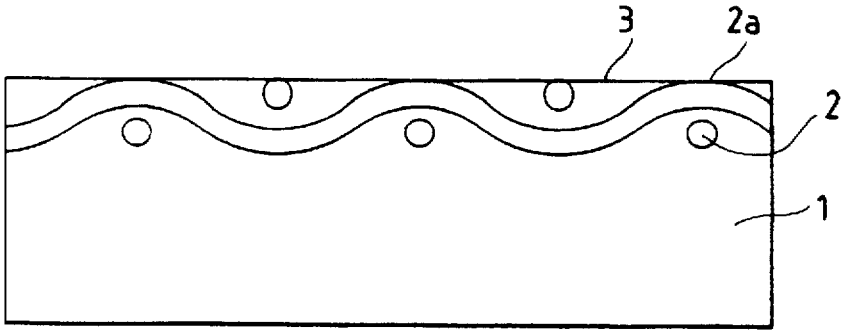
FIG. 17(b) (PRIOR ART)
Figure 18A:
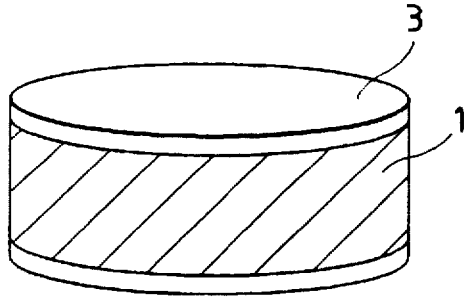
FIG. 18(a) (PRIOR ART)
FIGS. 18(*a*) and 18(*b*) show development of a thermal stress in the measurement of R-T characteristics of a conventional PTC thermistor.
Figure 18B:
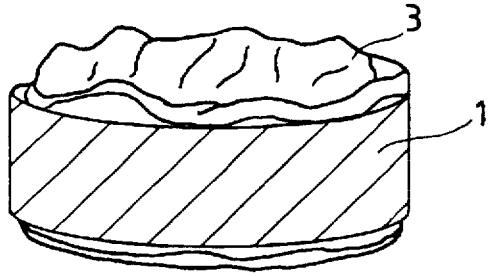
FIG. 18(b) (PRIOR ART)

According to the conventional method of electrode formation as shown in FIG. 17(*b*), in which plain weave mesh 2 is merely embedded in PTC sheet 1 by hot press bonding, it is only intersections 2*a* of mesh wires that is exposed on the surface of sheet 1. Therefore, the contact area between the mesh and metal layer 3 formed thereon by plating or vacuum evaporation is limited, resulting in an increase in initial resistivity. On the other hand, in Examples according to the invention as shown in FIG. 1(*b*), in which embedding of mesh 2 is followed by surface abrasion, the exposed area corresponding to intersections 2*a* of the mesh can be extended. As a result, the contact area with metal layer 3 is so increased, resulting in reduction in initial resistivity.

Where the electrode consists solely of metal layer 3 formed by plating or vacuum evaporation as shown in FIG. 18(*b*) (Reference Examples 1 and 3), PTC sheet 1 or metal layer 3 tend to undergo deformation or development of wrinkles or cracks due to the difference between the PTC sheet and the metal layer in coefficient of linear expansion. It seems that embedded mesh 2 as in Examples relaxes the stress at the openings of the mesh and also serves as a support of metal layer 3, producing a so-called anchor effect. The problems which might occur with the electrode formed solely of metal layer 3 can thus be solved.

According to the first-embodiment of the invention, in which WC is used as conductive powder to be incorporated into an organic polymer, a low resistivity can be obtained by addition of a smaller amount of the conductive powder than has been required of other conductive ceramic powders. As a result, kneading with the organic polymer and subsequent molding can be carried out easier to facilitate the production of small-sized thermistors for high-current circuits.

Further, since conductive ceramic powder is chemically more stable than metal and harder and more resistant to heat than metal or carbon black, it provides a highly reliable thermistor having excellent mechanical strength, stable resistivity, stability of performance against repetition of thermal cycles, and a high breakdown voltage. As compared with CB-containing thermistors, the WC-containing thermistors of the invention show a lower resistivity at room temperature and a greater rate of resistivity change with temperature.

Because of these advantages, the thermistor of the present invention are effective in uses where lower electrical resistance and higher heat resistance are demanded, for example, for prevention of overcurrent due to a shortcircuit of a charging or discharging circuit of secondary batteries, prevention of overcurrent due to lock of a motor typified by a door lock motor of automobiles, and prevention of overcurrent due to a shortcircuit of a telecommunication circuit.

In a preferred mode of the first embodiment, difficulty of kneading can be avoided by using WC powder having an average particle size of not smaller than 0.1 μm, and a thermistor having a low room temperature resistivity, a large rate of resistivity change, and a high breakdown voltage can be obtained by using WC powder having an average particle size of not greater than 10 μm.

In another preferred mode of the first embodiment, for example, polyvinylidene fluoride, polyethylene, polypropylene, polyvinyl chloride, polyvinyl acetate, an ionomer, or a copolymer comprising monomers of these polymers is selected as an organic polymer with which WC is to be kneaded, whereby a thermistor excellent in room temperature resistivity, rate of resistivity change, breakdown voltage, repeatability, and reliability can be obtained.

In still another preferred mode of the first embodiment, a thermistor having a low room temperature resistivity and a high rate of resistivity change can be obtained by adding at least 20% by volume of WC, and ease of kneading and molding can be assured to facilitate production of a thermistor by limiting the amount of WC added to 50% by volume at the most.

According to the second embodiment of the invention, there is provided an organic PTC thermistor which has a resistivity correspondent with the size of the molded PTC composition and exhibits resistivity stability and is useful for prevention of overcurrent due to a shortcircuit of a charging circuit of secondary batteries, lock of a motor typified by a door lock motor of automobiles, or a shortcircuit of a telecommunication circuit or OA equipment.

In a preferred mode of the second embodiment, a part of the metal mesh is exposed on the surface of the PTC composition, whereby the initial resistivity can further be lowered, and the stress due to thermal stress can be relaxed to afford mechanical reinforcement against deformation of the PTC composition or development of wrinkles or cracks in the electrode.

In another preferred mode of the second embodiment, the metal mesh used has an opening size of 200 to 600 mesh, whereby the resulting stock sheet can be punched or cut with ease and at low cost.

In still another preferred mode of the second embodiment, the metal mesh used is selected from plain weave mesh, twilled weave mesh, plain weave mesh having been squashed (flattened), twilled weave mesh having been squashed (flattened), and mesh with no difference in level at the intersections thereof, whereby a PTC element having a further reduced thickness can be prepared, the abrasion operation is easier, and the production process can be simplified.

In a further preferred mode of the second embodiment, the metal layer is formed by chemical plating, electroplating, vacuum vapor phase deposition or flame spray coating, whereby the initial resistivity can be lowered.

In a still further preferred mode of the second embodiment, the metal layer is formed on the abraded surface of the PTC composition including the embedded metal mesh, whereby the surface resistivity is stabilized and is further lowered.

In a yet further preferred mode of the second embodiment, WC is used as a conductive substance, whereby a PTC thermistor excellent in resistivity, rate of resistivity change, breakdown voltage, repetition stability of R-T characteristics, and reliability can be obtained.

While the invention has been described in detail and with reference to specific examples thereof, it will be apparent to one skilled in the art that various changes and modifications can be made therein without departing from the spirit and scope thereof.

What is claimed is:

1. An organic PTC thermistor having a positive temperature coefficient of resistivity, which comprises a PTC composition comprising an organic polymer having dispersed therein a conductive substance, and at least one pair of electrodes, wherein said conductive substance is tungsten carbide powder.

2. The organic PTC thermistor according to claim 1, wherein said tungsten carbide powder has an average particle size of 0.1 to 10 μm.

3. An organic PTC thermistor according to claim 1, wherein said organic polymer is at least one polymer selected from the group consisting of polyvinylidene fluoride, polyethylene, polypropylene, polyvinyl chloride, polyvinyl acetate, an ionomer, and a copolymer comprising monomers of these polymers.

4. An organic PTC thermistor according to claim 1, wherein said tungsten carbide powder is present in an amount of 20 to 50% by volume based on the total volume of the PTC composition.

5. An organic PTC thermistor according to claim 1, wherein said electrodes each have a structure composed of a metal mesh and a metal layer.

6. An organic PTC thermistor according to claim 5, wherein said metal mesh is embedded in the surface of said PTC composition, a part of said metal mesh being exposed.

7. An organic PTC thermistor according to claim 5, wherein said metal mesh has an opening size of 200 to 600 mesh.

8. An organic PTC thermistor according to claim 5, wherein said metal mesh is at least one of plain weave mesh, twilled weave mesh, plain weave mesh having been squashed, twilled weave mesh having been squashed, and mesh with no difference in level at the intersections.

9. An organic PTC thermistor according to claim 5, wherein said metal layer is formed by chemical plating, electroplating, vacuum vapor phase deposition or flame spray coating.

10. An organic PTC thermistor according to claim 5, wherein said metal layer is formed on an abraded surface of said PTC composition inclusive of said metal mesh.

11. The organic PTC thermistor according to claim 2, wherein said tungsten carbide powder has an average particle size of about 0.1 to 1 μm.

12. The organic PTC thermistor according to claim 11, wherein said tungsten carbide powder has an average particle size of about 0.5 to 1 μm.

13. The organic PTC thermistor according to claim 4, wherein said tungsten carbide powder is present in an amount of about 23 to 50% by volume.

14. The organic PTC thermistor according to claim 13, wherein said tungsten carbide powder is present in an amount of about 25 to 40% by volume.

15. An organic PTC thermistor having a positive temperature coefficient of resistivity, which comprises a PTC composition comprising an organic polymer having dispersed therein a conductive substance, and at least one pair of electrodes, wherein said electrodes each comprise a metal mesh and a metal layer.

16. An organic PTC thermistor according to claim 15, wherein said metal mesh is embedded in the surface of said PTC composition, a part of said metal mesh being exposed.

17. An organic PTC thermistor according to claim 15, wherein said metal mesh has an opening size of 200 to 600 mesh.

18. An organic PTC thermistor according to claim 15, wherein said metal mesh is at least one of plain weave mesh, twilled weave mesh, plain weave mesh having been squashed, twilled weave mesh having been squashed, and mesh with no difference in level at the intersections.

19. An organic PTC thermistor according to claim 15, wherein said metal layer is formed by chemical plating, electroplating, vacuum vapor phase deposition or flame spray coating.

20. An organic PTC thermistor according to claim 15, wherein said metal layer is formed on an abraded surface of said PTC composition inclusive of said metal mesh.

21. The organic PTC thermistor according to claim 15, wherein said organic polymer is at least one member selected from the group consisting of polyvinylidene fluoride, polyethylene, polypropylene, polyvinyl chloride, polyvinyl acetate, an ionomer, and a copolymer comprising monomers of these polymers, and said conductive substance is at least one member selected from the group consisting of carbon black, graphite, carbon fiber, conductive whiskers, metallic particles, and conductive ceramic powder.

22. An apparatus for preventing abnormal overheat of a fluorescent tube comprising a fluorescent tube and an organic PTC thermistor element having a positive temperature coefficient of resistivity which is thermally in contact with said fluorescent tube, said thermistor element comprising a PTC composition comprising an organic polymer having dispersed therein a conductive substance and at least one pair of electrodes, wherein said conductive substance is tungsten carbide powder.

23. The apparatus for preventing abnormal overheat of a fluorescent tube according to claim 22, wherein one electrode terminal of said thermistor element and one electrode lead of said fluorescent tube are electrically connected, and said thermistor element is integrated into a lighting circuit of said fluorescent tube with series connection.

24. The apparatus for preventing abnormal overheat of a fluorescent tube according to claim 22, wherein an increase of resistivity of said thermistor due to abnormal overheat of said fluorescent tube is detected in a detecting circuit dependent of the lighting circuit of said fluorescent tube.

25. The apparatus for preventing abnormal overheat of a fluorescent tube according to claim 22, wherein said tungsten carbide powder has an average particle size of about 0.1 to 1 μm.

26. The apparatus for preventing abnormal overheat of a fluorescent tube according to claim 22, wherein said tungsten carbide powder has an average particle size of about 0.5 to 1 μm.

27. The apparatus for preventing abnormal overheat of a fluorescent tube according to claim 22, wherein said tungsten carbide powder is present in an amount of about 23 to 50% by volume.

28. The apparatus for preventing abnormal overheat of a fluorescent tube according to claim 22, wherein said tungsten carbide powder is present in an amount of about 25 to 40% by volume.

* * * * *